US010447014B1

(12) United States Patent
Kikai et al.

(10) Patent No.: US 10,447,014 B1
(45) Date of Patent: Oct. 15, 2019

(54) SPARK PLUG AND MANUFACTURING METHOD THEREFOR

(71) Applicant: NGK SPARK PLUG CO., LTD., Nagoya-shi, Aichi (JP)

(72) Inventors: Takaaki Kikai, Nagoya (JP); Daisuke Sumoyama, Nagoya (JP); Takuto Nakada, Nagoya (JP)

(73) Assignee: NGK SPARK PLUG CO., LTD., Nagoya-shi (JP)

( * ) Notice: Subject to any disclaimer, the term of this patent is extended or adjusted under 35 U.S.C. 154(b) by 0 days.

(21) Appl. No.: 16/353,294

(22) Filed: Mar. 14, 2019

(30) Foreign Application Priority Data

Mar. 26, 2018 (JP) ..... 2018-057466

(51) Int. Cl.

| | |
|---|---|
| ***H01T 13/20*** | (2006.01) |
| ***H01T 13/39*** | (2006.01) |
| ***C22F 1/14*** | (2006.01) |
| ***C22C 5/04*** | (2006.01) |
| ***H01T 21/02*** | (2006.01) |

(52) U.S. Cl.
CPC ..... *H01T 13/39* (2013.01); *C22C 5/04* (2013.01); *C22F 1/14* (2013.01); *H01T 21/02* (2013.01)

(58) Field of Classification Search
None
See application file for complete search history.

(56) References Cited

U.S. PATENT DOCUMENTS

| | | | | |
|---|---|---|---|---|
| 2005/0194878 | A1* | 9/2005 | Watanabe | C22C 5/04 313/141 |
| 2013/0213107 | A1 | 8/2013 | Sakairi et al. | |
| 2017/0072458 | A1 | 3/2017 | Yoshikawa et al. | |

FOREIGN PATENT DOCUMENTS

| | | | |
|---|---|---|---|
| JP | 2012-136733 | A | 7/2012 |
| JP | 2013180909 | A * | 9/2013 |
| JP | 2015-190012 | A | 11/2015 |
| WO | WO-2019004273 | A1 * | 1/2019 |

* cited by examiner

*Primary Examiner* — Vip Patel
(74) *Attorney, Agent, or Firm* — Kusner & Jaffe

(57) ABSTRACT

A spark plug comprising: a first electrode including a tip containing 1r as a main material, and a base member to which the tip is joined; and a second electrode opposed to the tip with a spark gap therebetween. The number of crystal grains appearing in a range of 0.25 $mm^2$ on an arbitrary cross-section of the tip in a first direction connecting the tip and the second electrode within the spark gap, is not less than 20. When a length of each of the crystal grains in the first direction is denoted by Y, and a length of each of the crystal grains in a second direction perpendicular to the first direction is denoted by X, 5 μm≤X≤100 μm and Y/X≥1.5 are satisfied.

13 Claims, 4 Drawing Sheets

SPARK PLUG AND MANUFACTURING METHOD THEREFOR

RELATED APPLICATIONS

This application claims the benefit of Japanese Patent Application No. 2018-057466, filed Mar. 26, 2018, the entire content of which is incorporated herein by reference.

FIELD OF THE INVENTION

The present invention relates to a spark plug and a manufacturing method therefor and particularly relates to a spark plug that can improve the spark wear resistance of a tip, and a manufacturing method therefor.

BACKGROUND OF THE INVENTION

Japanese Patent Application Laid-Open (kokai) No. 2015-190012 discloses a technique in which the number of crystal grains in a cross-section in the longitudinal direction of a wire containing Ir, as a wire that can be used for an electrode (tip) of a spark plug, is set to be 2 to 20 per 0.25 $mm^2$. In the technique disclosed in Japanese Patent Application Laid-Open (kokai) No. 2015-190012, the areas of grain boundaries where oxidation easily occurs at high temperature as compared to crystal are decreased by reducing the number of crystal grains, so that high-temperature oxidation wear resistance is improved.

In the above conventional technique, however, it is doubtful whether an effect of inhibiting a reduction in volume of a tip by spark discharge (spark wear) is exhibited. Improvement of spark wear resistance is required for tips of spark plugs.

The present invention has been made to meet the above requirement. An advantage of the present invention is a spark plug that can improve the spark wear resistance of a tip, and a manufacturing method therefor.

SUMMARY OF THE INVENTION

In accordance with a first aspect of the present invention, there is provided a spark plug that includes: a first electrode including a tip containing Ir as a main material, and a base member to which the tip is joined; and a second electrode opposed to the tip with a spark gap therebetween. The number of crystal grains appearing in a range of 0.25 $mm^2$ on an arbitrary cross-section of the tip in a first direction connecting the tip and the second electrode within the spark gap, is not less than 20. When a length of each of the crystal grains in the first direction is denoted by Y and a length of each of the crystal grains in a second direction perpendicular to the first direction is denoted by X, $5\ \mu m \leq X \leq 100\ \mu m$ and $Y/X \geq 1.5$ are satisfied.

In the spark plug according to the first aspect, on the arbitrary cross-section of the tip in the first direction connecting the tip and the second electrode within the spark gap, 20 or more crystal grains appear in a range of 0.25 $mm^2$. The relationship between the length Y of each crystal grain in the first direction and the length X of each crystal grain in the second direction perpendicular to the first direction satisfies $5\ \mu m \leq X \leq 100\ \mu m$ and $Y/X \geq 1.5$. Thus, the spark wear resistance of the tip can be improved.

In accordance with a second aspect of the present invention, there is provided a spark plug as described above, wherein an amount of content of Ir on the cross-section of the tip is not greater than 4 mass %. Accordingly, in addition to the effect of the first aspect, local wear of the tip can be inhibited.

In accordance with a third aspect of the present invention, there is provided a spark plug as described above, wherein the relationship between a Vickers hardness Ha on the cross-section of the tip after heat treatment on the tip in an Ar atmosphere at 1300° C. for 10 hours and a Vickers hardness Hb on the cross-section of the tip before the treatment satisfies $Hb \geq 220$ HV and $Hb/Ha \leq 1.3$. Accordingly, in addition to the effect of the first or second aspect, while the hardness of the tip is ensured, recrystallization and grain growth at high temperature can be inhibited, so that the spark wear resistance of the tip can be maintained over a long period of time.

In accordance with a fourth aspect of the present invention, there is provided a spark plug as described above, wherein the tip further contains not less than 0.5 mass % of Rh. Thus, the recrystallization temperature can be decreased. As a result, in addition to any of the effects of the first to third aspects, the tip can be easily adjusted into a desired structure.

In accordance with a fifth aspect of the present invention, there is provided a manufacturing method for a spark plug including a preparation step, wherein a wire composed of a plurality of crystal grains and having a diameter corresponding to a diameter of the tip is prepared. In a heating step, a part in a longitudinal direction of the wire is heated to form a temperature gradient in the wire, thereby causing the crystal grains to grow in the longitudinal direction. As a result, the spark plug according to any one of the first to fourth aspects can be manufactured by using the wire as the tip.

In accordance with a sixth aspect of the present invention, there is provided a manufacturing method for a spark plug as describe above including a cooling step, wherein a part in the longitudinal direction of the wire is cooled. Thus, a temperature gradient can be more easily formed in the wire. Accordingly, in addition to the effect of the fifth aspect, the stability of the quality of the tip can be improved.

DETAILED DESCRIPTION OF THE INVENTION

Figure 1:
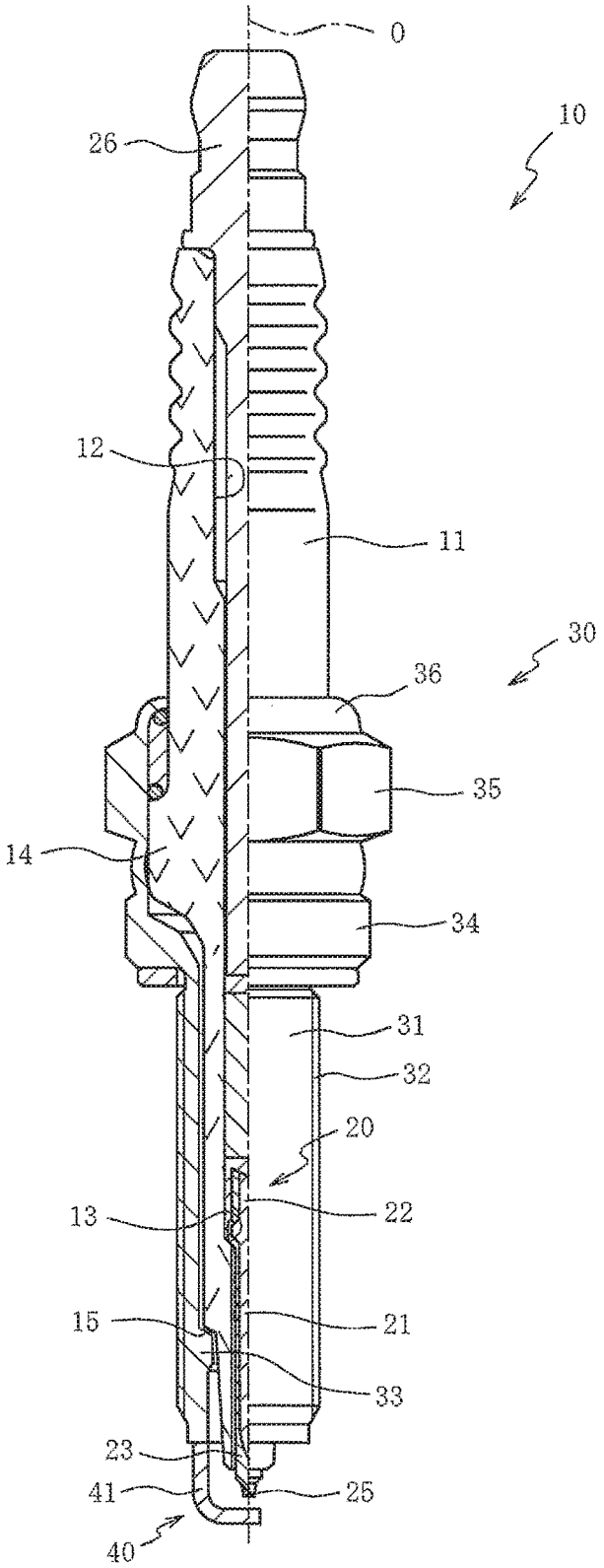
FIG. 1 is a half cross-sectional view of a spark plug according to an embodiment.
Figure 2:
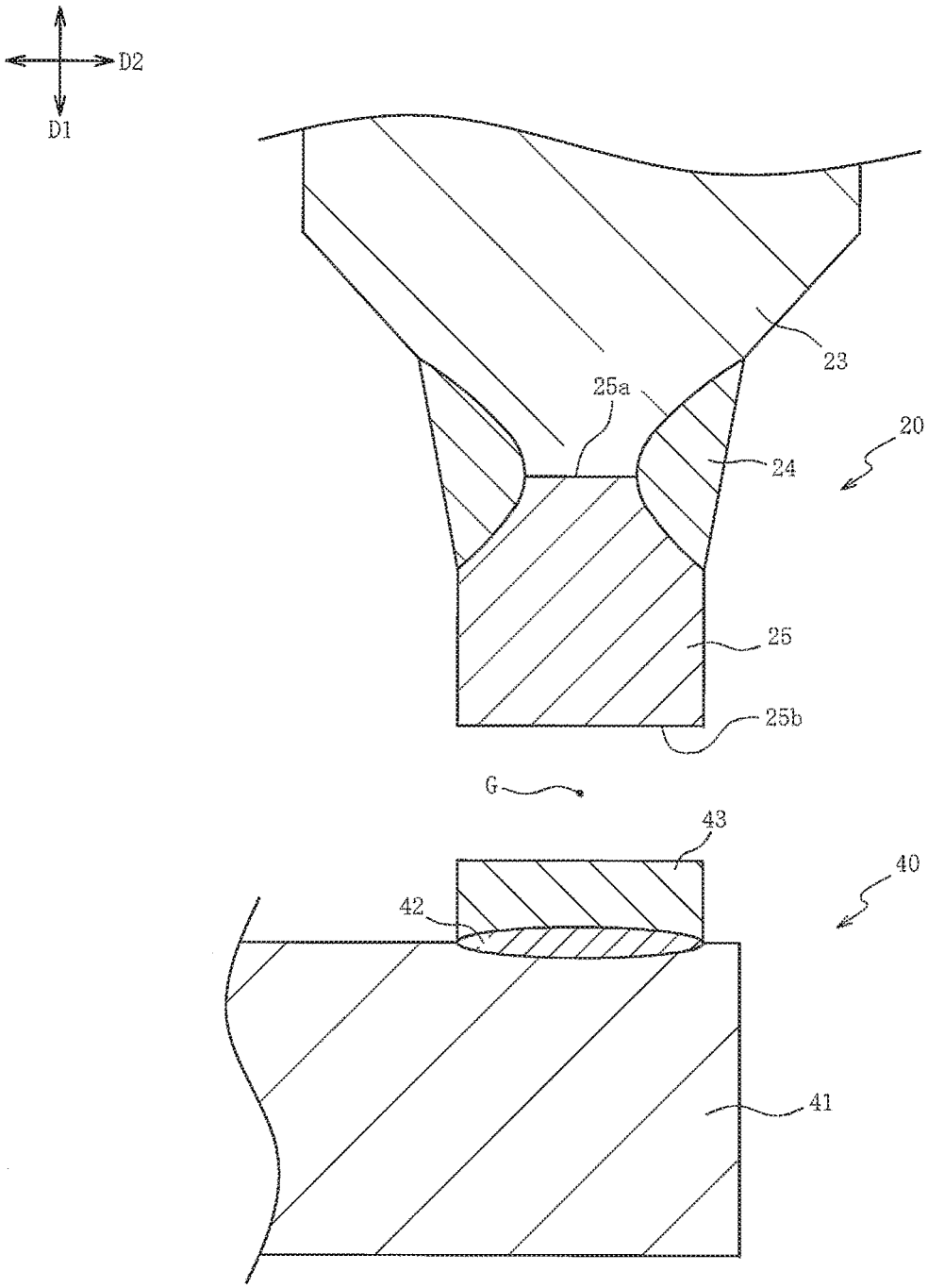
FIG. 2 is a partially-enlarged cross-sectional view of the spark plug in FIG. 1.

Hereinafter, preferred embodiments of the present invention will be described with reference to the accompanying drawings. FIG. 1 is a half cross-sectional view, with an axial line O as a boundary, of a spark plug 10 according to an embodiment, and FIG. 2 is a partially-enlarged cross-sectional view of the spark plug 10 in FIG. 1. In FIGS. 1 and 2, the lower side in the drawing sheet is referred to as a front side of the spark plug 10, and the upper side in the drawing sheet is referred to as a rear side of the spark plug 10.

As shown in FIG. 1, the spark plug 10 includes a center electrode 20 (first electrode) and a ground electrode 40 (second electrode). The center electrode 20 is fixed to an insulator 11, and the ground electrode 40 is connected to a metal shell 30. The insulator 11 is a substantially cylindrical member formed from alumina or the like which has an excellent mechanical property and insulation property at high temperature. The insulator 11 has an axial hole 12 that penetrates the insulator 11 along the axial line O. A rearward facing surface 13 that faces toward the rear side is formed at the front side of the axial hole 12 over the entire periphery. The insulator 11 has a large-diameter portion 14 formed at the center thereof in the axial line direction and having a largest outer diameter. The insulator 11 has an engagement portion 15 formed at the front side with respect to the large-diameter portion 14 so as to project radially outward. The engagement portion 15 has a diameter decreasing toward the front side.

The center electrode 20 is a rod-shaped member that is disposed in the axial hole 12. The center electrode 20 includes: an axial portion 21 that is disposed at the front side in the axial hole 12 with respect to the rearward facing surface 13; and a head portion 22 that is engaged with the rearward facing surface 13. A part of the axial portion 21 projects from the axial hole 12. In the center electrode 20, a core material having excellent thermal conductivity is embedded in a base member 23. In the present embodiment, the base member 23 is formed from Ni or an alloy containing Ni as a main material, and the core material is formed from copper or an alloy containing copper as a main material. The core material may be omitted.

As shown in FIG. 2, the center electrode 20 has a melt portion 24 formed at the front end of the base member 23, and a tip 25 is joined thereto. The melt portion 24 is formed by resistance welding, laser welding, electron-beam welding, or the like, and is obtained by the base member 23 and the tip 25 being melted and blended together. In the present embodiment, the melt portion 24 is formed over the entire periphery of the base member 23 by laser welding.

The tip 25 is formed from an alloy containing Ir as a main material or a metal composed of Ir. The alloy containing Ir as a main material means that the content of Ir in the alloy is not less than 50 wt %. The metal composed of Ir refers to a metal containing inevitable impurities in addition to Ir. In the present embodiment, the tip 25 is a columnar member formed from an alloy containing Ir as a main material. The tip 25 can contain Pt, Rh, Ru, Ni, etc., in addition to Ir.

In the present embodiment, a state where a center portion of an end face 25*a* of the tip 25 abutted against the base member 23 remains and the melt portion 24 is formed therearound, is illustrated in the drawing. However, the present invention is not limited thereto. The entire end face 25*a* of the tip 25 may be melted into the melt portion 24 to disappear.

Referring back to FIG. 1, a metal terminal 26 is a rod-shaped member to which a high-voltage cable (not shown) is to be connected, and is formed from a metallic material having electrical conductivity (for example, low-carbon steel). The metal terminal 26 is fixed to the rear end of the insulator 11 and the front side thereof is disposed within the axial hole 12. The metal terminal 26 is electrically connected to the center electrode 20 within the axial hole 12.

The metal shell 30 is a cylindrical member that is disposed on the outer periphery of the insulator 11. The metal shell 30 is formed from a metallic material having electrical conductivity (for example, low-carbon steel, etc.). The metal shell 30 includes: a trunk portion 31 that surrounds a part of the front side of the insulator 11; a seat portion 34 that is connected to the rear side of the trunk portion 31; a tool engagement portion 35 that is connected to the rear side of the seat portion 34; and a rear end portion 36 that is connected to the rear side of the tool engagement portion 35. An external thread 32 that is to be screwed into a thread hole of an engine (not shown) is formed on the outer periphery of the trunk portion 31, and a ledge portion 33 that engages the engagement portion 15 of the insulator 11 from the front side is formed on the inner periphery of the trunk portion 31.

The seat portion 34 is a portion for closing the gap between the thread hole of the engine and the external thread 32 and is formed with an outer diameter larger than that of the trunk portion 31. The tool engagement portion 35 is a portion with which a tool such as a wrench is brought into engagement when the external thread 32 is fastened to the thread hole of the engine. The rear end portion 36 bends radially inward and is located at the rear side with respect to the large-diameter portion 14 of the insulator 11. The metal shell 30 holds the large-diameter portion 14 and the engagement portion 15 of the insulator 11 by the ledge portion 33 and the rear end portion 36.

The ground electrode 40 is a member that is connected to the trunk portion 31 of the metal shell 30. In the present embodiment, the ground electrode 40 includes: a base member 41 that is connected to the metal shell 30; and a tip 43 that is joined to the base member 41 via a melt portion 42 (see FIG. 2). The base member 41 is made of a metal having electrical conductivity (for example, a nickel-based alloy). The tip 43 is a member formed from an alloy containing a noble metal, such as Pt, Ir, Ru, and Rh, as a main material, or a noble metal. The melt portion 42 is formed by resistance welding, laser welding, electron-beam welding, or the like, and is obtained by the base member 41 and the tip 43 being melted and blended together. In the present embodiment, the melt portion 42 is formed by resistance welding.

In the spark plug 10 (see FIG. 1), an end face 25*b* of the tip 25 of the center electrode 20 and the ground electrode 40 (tip 43) are spaced apart from each other in a first direction D1, whereby a spark gap G is formed between the end face 25*b* of the tip 25 and the ground electrode 40. In the present embodiment, the first direction D1 coincides with the direction of the axial line O. On an arbitrary cross-section, in the first direction D1, of the tip 25, 20 or more crystal grains appear in a range of 0.25 $mm^2$ (a visual field having a 0.5 mm×0.5 mm square shape). In the tip 25, the relationship between a length Y of each crystal grain in the first direction D1 and a length X of each crystal grain in a second direction D2 perpendicular to the first direction D1 satisfies 5 μm≤X≤100 μm and Y/X≥1.5. Accordingly, the spark wear resistance of the tip 25 can be improved.

Figure 3:
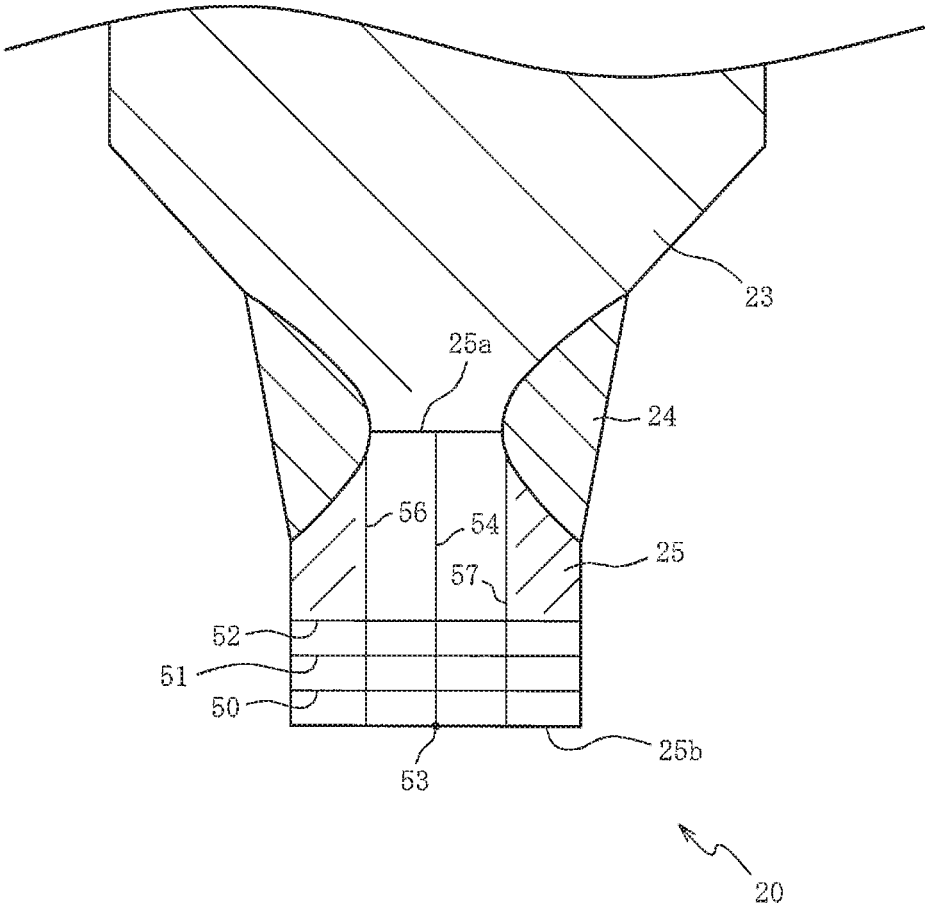
FIG. 3 is a cross-sectional view of a tip.

An example of a method for measuring the lengths (X, Y) of the crystal grains of the tip 25 will be described with reference to FIG. 3. FIG. 3 is a cross-sectional view, including the axial line O (see FIG. 1), of the tip 25. The lengths of the crystal grains are measured according to JIS G0551: 2013. For example, for the tip 25 joined to the base member 23 (the tip 25 that has been thermally affected through formation of the melt portion 24), the tip 25 is cut along a plane including the axial line O, whereby the tip 25 is divided into two sections. One of the two sections of the divided tip 25 is polished such that a flat cross-section appears, and a photomicrograph of a composition image is obtained by using a metallographical microscope or an SEM.

A test line 50 that is a straight line is drawn parallel to the end face 25*b* at a position away from the end face 25*b* by 0.05 mm on the obtained photomicrograph. Next, a test line 51 that is a straight line is drawn parallel to the test line 50 at a position away from the test line 50 by 0.05 mm. Furthermore, a test line 52 that is a straight line is drawn parallel to the test line 51 at a position away from the test line 51 by 0.05 mm. When three test lines 50, 51, and 52 cannot be drawn on the tip 25 since the length, in the first direction D1, of the tip 25 is short, the intervals (0.05 mm) between the test lines 50, 51, and 52 may be shortened, or the interval (0.05 mm) between the end face 25*b* and the test line 50 may be shortened without changing the intervals between the test lines 50, 51, and 52.

Next, the numbers ($N_1$, $N_2$, $N_3$) of crystal grains of the tip 25 through which the respective test lines 50, 51, and 52 pass or which are captured by the respective test lines 50, 51, and 52, are counted. Counting of the numbers of crystal grains is performed on the basis of the manner of crossing of each test line 50, 51, 52 and a crystal grain. That is, when the test line 50, 51, 52 passes through a crystal grain, $N_1$, $N_2$, $N_3$=1; when the test line 50, 51, 52 terminates within a crystal grain, $N_1$, $N_2$, $N_3$=0.5; and when the test line 50, 51, 52 is in contact with a grain boundary, $N_1$, $N_2$, $N_3$=0.5. When a portion of the test line 50, 51, 52 that crosses a crystal grain of the tip 25 is denoted by $X_1$, $X_2$, $X_3$, respectively, the length (X) of the crystal grain of the tip 25 in the second direction D2 is represented by $(X_1+X_2+X_3)/(N_1+N_2+N_3)$.

Next, a test line 54 that is a straight line passing through a midpoint 53 of a line segment on the end face 25*b* of the tip 25 and perpendicular to the test lines 50, 51, and 52 is drawn on the photomicrograph. Furthermore, test lines 56 and 57 that are straight lines are drawn parallel to the test line 54 at both sides of the test line 54 at positions away from the test line 54 by 100 μm. The test lines 54, 56, and 57 are drawn from the end face 25*b* to the melt portion 24 or the end face 25*a*.

Next, the numbers ($M_1$, $M_2$, $M_3$) of crystal grains of the tip 25 through which the respective test lines 54, 56, and 57 pass or which are captured by the respective test lines 54, 56, and 57, are counted. Counting of the numbers ($M_1$, $M_2$, $M_3$) of crystal grains is performed in the same manner as the counting for the numbers $N_1$, $N_2$, $N_3$. When a portion of the test line 54, 56, 57 that crosses a crystal grain is denoted by $Y_1$, $Y_2$, $Y_3$, respectively, the length (Y) of the crystal grain in the first direction D1 is represented by $(Y_1+Y_2+Y_3)/(M_1+M_2+M_3)$.

In the tip 25, the difference (range) between the maximum value and the minimum value among measurement values measured for content of Ir at a plurality of measurement points on the cross-section on which the lengths of the crystal grains have been measured, is set to be not greater than 4 wt %. Excessive segregation of Ir can be inhibited, and thus local wear of the tip 25 can be inhibited. The content of Ir can be measured by WDS analysis using an EPMA.

When the Vickers hardness on the cross-section of the tip 25 after heat treatment on the tip 25 in an Ar atmosphere at 1300° C. for 10 hours is denoted by Ha, and the Vickers hardness on the cross-section of the tip 25 before the treatment is denoted by Hb, Hb≥220 HV and Hb/Ha≤1.3 are satisfied. Accordingly, while the hardness of the tip 25 is ensured, recrystallization and grain growth at high temperature can be inhibited, so that the spark wear resistance of the tip 25 can be maintained over a long period of time.

The structure and the hardness of the tip 25 can be controlled by: the welding method; the atmosphere during welding; the irradiation conditions of laser beam or electron beam used for welding; the material, the shape, etc., of the tip 25 (the cross-sectional area or the length, in the first direction D1, of the tip 25); the processing conditions when the tip 25 is manufactured; and the like.

The Vickers hardness of the tip 25 is measured according to JIS Z2244: 2009. The cut surface of the tip 25 on which the lengths (X, Y) of the crystal grains of the tip 25 have been measured is mirror-finished to provide a test piece to be measured for Vickers hardness Hb. The cut surface of the other of the two sections obtained by cutting and dividing the tip 25 along the plane including the axial line O is mirror-finished to provide a test piece to be measured for Vickers hardness Ha.

If it is not possible to produce test pieces by cutting and dividing the tip 25 into two sections, two spark plugs 10 manufactured under the same conditions may be prepared, a test piece to be measured for Vickers hardness Hb may be produced by using one of the spark plugs 10, and a test piece to be measured for Vickers hardness Ha may be produced by using the other spark plug 10.

The test piece to be measured for Vickers hardness Ha is subjected to heat treatment before the cut surface thereof is mirror-finished. The heat treatment is a treatment including: putting, in an atmosphere furnace, the tip 25 (the base member 23 and the melt portion 24 may be included) that has been thermally affected through formation of the melt portion 24; increasing the temperature at a rate of 10° C./min up to 1300° C. while letting Ar flow at a flow rate of 2 L/min; maintaining heating at 1300° C. for 10 hours; then stopping the heating; and naturally cooling the tip 25 while letting Ar flow at a flow rate of 2 L/min. The purpose of the heat treatment is to remove residual stress from the tip 25, and to adjust the crystal structure of the tip 25 that has been changed due to influences of the processing, the welding heat, etc.

Measurement points (points to which an indenter is pushed) for each of the Vickers hardnesses Ha and Hb are set at positions away from the edge of the tip 25 by 0.10 mm. Four measurement points at which indentations caused by pushing the indenter are away from each other by 0.4 mm are selected. When an indentation is included in the melt portion 24 or when an indentation is included in a region within 100 μm from the boundary between the melt portion 24 and the tip 25, the indentation is excluded from the measurement values. The purpose of this is to prevent the measurement values from being influenced by the melt portion 24. A test force to be applied to the indenter is set to 1.96 N (200 gf), and the test force holding time is set to 10 seconds. The arithmetic average value of measurement values obtained at the four measurement points is calculated and defined as Vickers hardness Ha, Hb.

Figure 4:
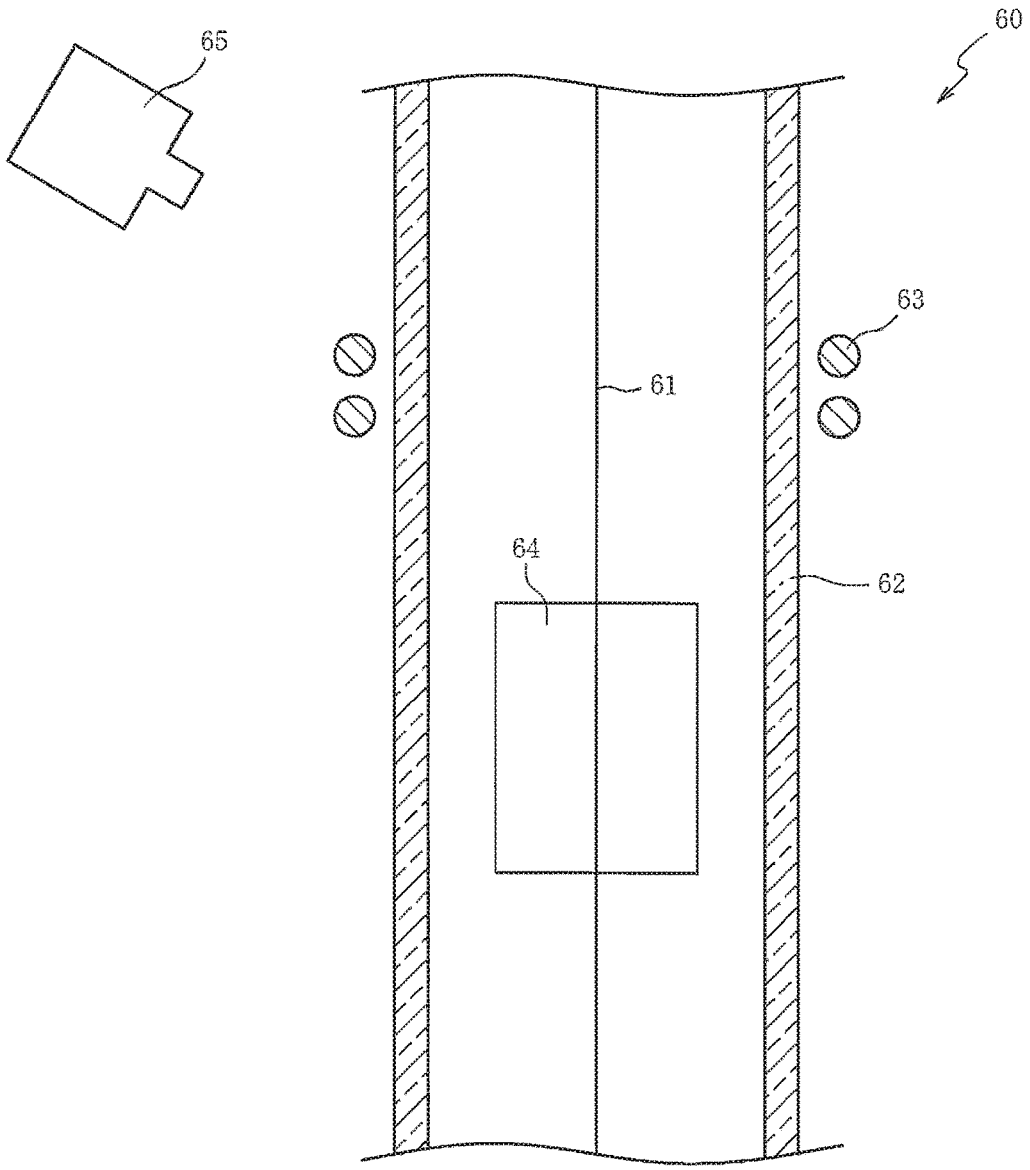
FIG. 4 is a schematic diagram of a heating device.

The manufacturing method for the tip 25 will be described with reference to FIG. 4. FIG. 4 is a schematic diagram of a heating device 60 in which a wire 61 that is to be the material of the tip 25 is heated. In FIG. 4, both ends in the longitudinal direction of the heating device 60 are omitted. The heating device 60 is a device that heats the wire 61 having a diameter corresponding to the diameter of the tip 25, thereby adjusting the structure of the wire 61. The wire 61 is formed from an alloy containing Ir as a main material, and the alloy further contains not less than 0.5 mass % of Rh. The wire 61 is composed of a plurality of crystal grains, and the length X of each crystal grain in the transverse direction of the wire 61 is not greater than 100 μm.

The heating device 60 includes: a transparent tube 62 that is formed from quartz glass or the like; a heater 63 that is disposed at a predetermined position outside the tube 62; a cooler 64 that is disposed inside the tube 62 so as to be spaced apart from the heater 63 in the axial direction; and a thermometer 65 for measuring the temperature of the wire 61 heated by the heater 63. The wire 61 that is disposed inside the tube 62 is held by a chuck (not shown) disposed at a position away from the heater 63.

The tube 62 is a member for ensuring an atmosphere in which the wire 61 is heated, and an inert gas such as Ar gas is flowed into the tube 62 as necessary. The heater 63 serves to heat a part in the longitudinal direction of the wire 61. In the wire 61, in the part in the longitudinal direction that has been heated by the heater 63, a temperature gradient is formed in the longitudinal direction. In the present embodiment, the heater 63 is a coil for high frequency induction heating. The heater 63 heats the wire 61 to a temperature at which the wire 61 is not melted. The temperature that the wire 61 heated by the heater 63 reaches depends on the composition of the wire 61, but is, for example, approximately 1000 to 1500° C.

The cooler 64 serves to cool a part in the longitudinal direction of the wire 61. Since the cooler 64 is disposed so as to be spaced apart from the heater 63 in the axial direction, a temperature gradient can be more easily formed in the wire 61. In the present embodiment, the cooler 64 is a block that is cooled by water cooling and made of a metal, and is in contact with the wire 61. The thermometer 65 measures the temperature of the wire 61 at the position of the heater 63. In the present embodiment, the thermometer 65 is a radiation thermometer.

In a heating step, the heater 63 heats a part of the wire 61, and, in a cooling step, the cooler 64 cools a part of the wire 61. Accordingly, a temperature gradient in the longitudinal direction is formed in the wire 61, and the crystal grains that form the wire 61 grow in the longitudinal direction. When the chuck moves in the longitudinal direction of the wire 61 in a state where the chuck holds the wire 61, the wire 61 moves in the longitudinal direction. Accordingly, a temperature gradient is sequentially formed in the wire 61, and a portion where the crystal grains have grown in the longitudinal direction is sequentially formed in the wire 61.

The tip 25 is produced by cutting the heated wire 61 into a certain length. Thus, the lengths Y of the crystal grains in the first direction D1 (in the longitudinal direction of the wire 61) of the tip 25 can be lengthened. By setting the heating time for the wire 61, the magnitude of the temperature gradient, etc., the tip 25 in which the crystal grains satisfy $5\ \mu m \leq X \leq 100\ \mu m$ and $Y/X \geq 1.5$ can be produced. Furthermore, since the cooler 64 cools a part in the longitudinal direction of the wire 61, a temperature gradient can be more easily formed, so that the stability of the quality of the tip 25 in which $5\ \mu m \leq X \leq 100\ \mu m$ and $Y/X \geq 1.5$ are satisfied can be improved.

Since the wire 61 is heated to a temperature at which the wire 61 is not melted, the structure of the tip 25 can be adjusted while variation in composition caused by solidification segregation during heating by the heating device 60 is prevented. Accordingly, the tip 25 having excellent spark wear resistance can be stably manufactured. Since the wire 61 contains not less than 0.5 mass % of Rh in addition to Ir, grain growth can be caused to occur in the air atmosphere. Furthermore, the recrystallization temperature is decreased by Rh, and thus the wire 61 can be easily adjusted into a desired structure.

The spark plug 10 is manufactured using the obtained tip 25, for example, by the following method. First, the center electrode 20 having the tip 25 joined to the base member 23 is inserted into the axial hole 12 of the insulator 11, whereby the center electrode 20 is disposed in the axial hole 12. Next, the metal terminal 26 is fixed to the rear end of the insulator 11 with conduction ensured between the metal terminal 26 and the center electrode 20. Next, the insulator 11 is inserted into the metal shell 30 to which the ground electrode 40 has been joined in advance, and the rear end portion 36 is bent, whereby the metal shell 30 is mounted to the insulator 11. Next, the ground electrode 40 is bent such that the ground electrode 40 is opposed to the tip 25 of the center electrode 20, whereby the spark plug 10 is obtained.

In the present embodiment, the case where the heating device 60 includes the tube 62 has been described, but the present invention is not necessarily limited thereto. As a matter of course, the tube 62 may be omitted if no problem arises due to oxidation or the like even when the wire 61 is heated in the air atmosphere.

In the present embodiment, the case where the coil for high frequency induction heating is used as the heater 63 has been described, but the present invention is not necessarily limited thereto. As a matter of course, an electric furnace (heating element), a burner, or the like may be used as the heater 63.

In the present embodiment, the case where the block that is cooled by water and made of a metal is used as the cooler 64 has been described, but the present invention is not necessarily limited thereto. As a matter of course, a pipe in which a fluid such as water flows, a nozzle that discharges a fluid such as a cooling liquid or gas toward the wire 61, a Peltier device, or the like may be used as the cooler 64. The cooler 64 may be omitted. This is because a temperature gradient can be formed in the wire 61 by the heater 63 even when the cooler 64 is omitted.

In the present embodiment, the case where the wire 61 is moved in the longitudinal direction and a temperature gradient is sequentially formed in the wire 61 has been described, but the present invention is not necessarily limited thereto. As a matter of course, the heater 63 and the cooler 64 may be moved along the wire 61 instead of moving the wire 61 in the longitudinal direction. In addition, as a matter of course, a mechanism for moving the wire 61 or the heater 63 and the cooler 64 may be omitted. This is because, when a temperature gradient is formed in the wire 61, grain growth occurs without moving the wire 61 or the heater 63, etc.

Examples

The present invention will be described in more detail by means of examples. However, the present invention is not limited to the examples.

(Production of Samples)

An examiner obtained various wires by heating parts of various wires and cooling other parts of the wires to form temperature gradients in the wires, and then obtained various columnar tips 25 having the same dimensions by cutting the obtained wires. The examiner abutted end faces of base members 23 having the same dimensions and the end faces 25*a* of the tips 25 against each other, and then applied a laser beam to the boundaries between the base members 23 and the tips 25 over the entire periphery by using a fiber laser welding machine to form melt portions 24, whereby various center electrodes 20 were obtained. The energy to be applied to the base members 23 and the tips 25 by the fiber laser welding machine was adjusted such that the tips 25 having different compositions had the same length in the axial line direction from the boundary between the melt portion 24 and the tip 25 to the end face 25*b* of the tip 25.

Each of the various center electrodes 20 obtained was fixed to an insulator 11, and a metal shell 30 was mounted to the insulator 11, whereby spark plugs 10 of samples 2 to 16 were obtained. For comparison, a spark plug of sample 1 was obtained in the same manner as for the samples 2 to 16, except that a columnar tip was produced using a wire that was not subjected to heating treatment and cooling treatment. Multiple types of analysis were performed for each sample, and thus a plurality of spark plugs produced under the same conditions were prepared for each sample.

TABLE 1

| | Composition (wt %) | | | | | | Crystal grain | | | | |
|---|---|---|---|---|---|---|---|---|---|---|---|
| No | Ir | Pt | Rh | Ru | Ni | Range | Number | X (μm) | Y/X | Hb/Ha | Determination |
| 1 | 90.0 | 10.0 | 0 | 0 | 0 | 1.0 | >6600 | <5 | >1.5 | 2.0 | — |
| 2 | 90.0 | 10.0 | 0 | 0 | 0 | 1.0 | 2050 | 10 | 1.2 | 1.3 | C |
| 3 | 90.0 | 10.0 | 0 | 0 | 0 | 2.0 | >6600 | <5 | 1.5 | 1.3 | C |
| 4 | 90.0 | 10.0 | 0 | 0 | 0 | 5.0 | 1650 | 10 | 1.5 | 1.3 | B |
| 5 | 90.0 | 10.0 | 0 | 0 | 0 | 2.0 | 6600 | 5 | 1.5 | 1.3 | A |
| 6 | 90.0 | 10.0 | 0 | 0 | 0 | 2.0 | 1650 | 10 | 1.5 | 1.3 | A |
| 7 | 90.0 | 10.0 | 0 | 0 | 0 | 2.0 | 400 | 20 | 1.5 | 1.3 | A |
| 8 | 99.5 | 0 | 0.5 | 0 | 0 | 0.5 | 400 | 20 | 1.5 | 1.3 | A |
| 9 | 90.0 | 0 | 10.0 | 0 | 0 | 2.0 | 400 | 20 | 1.5 | 1.3 | A |
| 10 | 80.0 | 0 | 20.0 | 0 | 0 | 2.0 | 400 | 20 | 1.5 | 1.3 | A |
| 11 | 93.0 | 5.0 | 1.0 | 0 | 1.0 | 2.0 | 400 | 20 | 1.5 | 1.3 | A |
| 12 | 79.0 | 0 | 10.0 | 10.0 | 1.0 | 2.0 | 400 | 20 | 1.5 | 1.3 | A |
| 13 | 69.0 | 0 | 20.0 | 10.0 | 1.0 | 2.0 | 400 | 20 | 1.5 | 1.3 | A |
| 14 | 69.0 | 0 | 20.0 | 10.0 | 1.0 | 2.0 | 24 | 80 | 1.5 | 1.3 | A |
| 15 | 69.0 | 0 | 20.0 | 10.0 | 1.0 | 2.0 | 125 | 20 | 5.0 | 1.3 | A |
| 16 | 69.0 | 0 | 20.0 | 10.0 | 1.0 | 2.0 | 400 | 20 | 1.5 | 1.2 | A |

Table 1 is a list of the compositions and the structures of the tips 25 of the spark plugs 10 of the samples 1 to 16.

The composition of each tip 25 was measured by WDS analysis (acceleration voltage: 20 kV, spot diameter of measurement area: 1 μm) using an EPMA (JXA-8500F, manufactured by JEOL Ltd.). First, the tip 25 was cut along a plane including the axial line O, and the composition at an arbitrary measurement point on the cut surface was measured. Next, the composition at a measurement point having a center at a position away from the center of the measurement point by only 0.5 μm was measured. This operation was sequentially performed, and the compositions at 10 measurement points set at intervals of 0.5 μm were measured. Each value of the composition shown in Table 1 is the arithmetic average value of measurement values at these 10 points. An element for which a value shown in Table 1 is 0 (zero) indicates that the content thereof is not greater than the detection limit. Furthermore, the examiner carried out this analysis (measurement at 10 points) at arbitrary positions on the same cut surface five times, and calculated the difference (range) between the maximum value and the minimum value among 50 measurement values for Ir in total.

As described above, the examiner measured the number of crystal grains appearing in a visual field having a 0.5 mm×0.5 mm square shape (a range of 0.25 $mm^2$) on a cross-section including the axial line O (a cross-section in the first direction D1) of the tip 25, the lengths X of the crystal grains, Y/X, and the Vickers hardness Hb/Ha. The results are shown in Table 1. In all the samples, Hb≥220 HV.

(Spark Wear Test)

The examiner obtained information about the dimensions of the tip 25 of each sample, which is a spark plug, by using a projector, calculated the volume (Vb) of the tip 25, and then attached each sample to a chamber. The examiner filled the chamber with nitrogen gas (flow rate: 0.5 L/min) and pressurized the chamber to 0.6 MPa. In this state, the examiner carried out a test of causing spark discharge between the tip 25 and the ground electrode 40 of the center electrode 20 in a cycle of 100 Hz for 150 hours.

After the test, the examiner detached each spark plug from the chamber, obtained information about the dimensions of the tip 25 by using the projector, and calculated the volume (Va) of the tip 25. Next, the examiner calculated a volume (Vb−Va, hereinafter, referred to as "wear volume") by subtracting the volume (Va) of the tip 25 after the test from the volume (Vb) of the tip 25 before the test.

As shown in Table 1, regarding the sample 1 (comparative example), the number of crystal grains appearing in an area of 0.25 $mm^2$ was not less than 20, and the amount of content of Ir was not greater than 4 mass %. Y/X≥1.5 was satisfied, whereas X<5 μm. In addition, Hb/Ha>1.3.

Determination was categorized into three ranks A to C on the basis of the ratio (V/V1) of the wear volume (V) of each sample to the wear volume (V1) of the sample 1. The criteria are as follows. A: V/V1<0.85, B: 0.85≤V/V1<0.95, C: V/V1≥0.95. Lower V/V1 indicates that the amount of wear of the tip is smaller and the spark wear resistance is better as compared to those of the sample 1 (comparative example). The results are shown in Table 1.

As shown in Table 1, the samples 5 to 16 were determined as A. Regarding the samples 5 to 16, the number of crystal grains appearing in an area of 0.25 $mm^2$ was not less than 20, and the lengths X and Y of the crystal grains satisfied 5 μm≤X≤100 μm and Y/X≥1.5. The amount of content of Ir was not greater than 4 mass %, and Hb/Ha≤1.3. The mechanism of the spark wear resistance improving when the number of crystal grains appearing in an area of 0.25 $mm^2$ is not less than 20, and 5 μm≤X≤100 μm and Y/X≥1.5 are satisfied, is unclear. However, it is inferred that the crystal grains that are extended in the first direction D1 and grain boundaries that are dense in the second direction D2 inhibit spark wear.

The sample 4 was determined as B. Regarding the sample 4, the number of crystal grains appearing in an area of 0.25 $mm^2$ was not less than 20, and the lengths X and Y of the crystal grains satisfied 5 μm≤X≤100 μm and Y/X≥1.5. Hb/Ha≤1.3, but the amount of content of Ir was 5 mass %. The sample 4 has a wider amount of content of Ir than the samples 5 to 16, and thus it is inferred that spark wear progressed due to segregation of Ir as compared to that of the samples 5 to 16.

The samples 2 and 3 (comparative examples) were determined as C. Regarding the sample 3, the number of crystal grains appearing in a range of 0.25 $mm^2$ was not less than 20. The range of content of Ir was not greater than 4 mass %, and Hb/Ha≤1.3. Y/X≥1.5 was satisfied, whereas X<5 μm.

The sample 3 has shorter lengths X in the second direction D2 of the crystal grains than the samples 4 to 16, and thus it is inferred that grain boundaries became excessively dense in the second direction D2 and spark wear progressed as compared to that of the samples 4 to 16.

Regarding the sample 2, the number of crystal grains appearing in an area of 0.25 $mm^2$ was not less than 20. The amount of content of Ir was not greater than 4 mass %, and Hb/Ha≤1.3. 5 μm≤X≤100 μm was satisfied, whereas Y/X<1.5. In the sample 2, Y/X<1.5, and thus it is inferred that the lengths Y in the first direction D1 of the crystal grains were insufficient and spark wear progressed as compared to that of the samples 4 to 16.

Although the present invention has been described based on the embodiment, the present invention is not limited to the above embodiment at all. It can be easily understood that various modifications may be made without departing from the gist of the present invention.

The case where the tip 25 has a columnar shape has been described in the embodiment, but the present invention is not necessarily limited thereto. As a matter of course, another shape may be adopted. Examples of other shapes of the tip 25 include a truncated cone shape, an elliptical column shape, and polygonal column shapes such as a triangular column shape and a quadrangular column shape.

The case where the tip 25 satisfies predetermined conditions (the center electrode 20 is the first electrode) in order to improve the spark wear resistance of the tip 25 of the center electrode 20, has been described in the embodiment. However, the present invention is not necessarily limited thereto. In the case of improving the spark wear resistance of the tip 43 of the ground electrode 40, the tip 43 only needs to satisfy the predetermined conditions (the ground electrode 40 is the first electrode, and the center electrode 20 is the second electrode).

The case where the tip 25 is joined to the base member 23 of the center electrode 20 has been described in the embodiment, but the present invention is not necessarily limited thereto. As a matter of course, an intermediate member formed from a Ni-based alloy or the like may be interposed between the base member 23 and the tip 25. In this case, the intermediate member is a part of the base member 23. Also, as a matter of course, in the case where the ground electrode 40 is the first electrode, an intermediate member formed from a Ni-based alloy or the like may be interposed between the base member 41 and the tip 43. In this case, the intermediate member is a part of the base member 41.

The case where the tip 25 of the center electrode 20, which is the first electrode, and the ground electrode 40, which is the second electrode, are opposed to each other in the direction of the axial line O and the spark gap G is formed therebetween, has been described in the embodiment. However, the present invention is not necessarily limited thereto. As a matter of course, the tip of the first electrode and the second electrode may be opposed to each other in a direction crossing the axial line O, and a spark gap may be formed therebetween. In this case, a direction connecting the tip and the second electrode within the spark gap is the first direction. The first direction crosses the direction of the axial line O, and thus the direction of the axial line O is not always the first direction. The first direction and the second direction are set on the basis of the positions at which the tip of the first electrode and the second electrode are disposed.

DESCRIPTION OF REFERENCE NUMERALS

10: spark plug;
20: center electrode (first electrode);
23: base member;
25: tip;
40: ground electrode (second electrode);
61: wire;
D1: first direction;
D2: second direction;
G: spark gap.

Having described the invention, the following is claimed:

1. A spark plug comprising:

a first electrode including a tip containing Ir as a main material, and a base member to which the tip is joined; and a second electrode opposed to the tip with a spark gap therebetween, wherein a number of crystal grains appearing in an area of 0.25 $mm^2$ on an arbitrary cross-section of the tip in a first direction connecting the tip and the second electrode within the spark gap, is not less than 20 crystal grains, and when a length of each of the crystal grains in the first direction is denoted by Y and a length of each of the crystal grains in a second direction perpendicular to the first direction is denoted by X, 5 μm≤X≤100 μm and Y/X≥1.5 are satisfied.

2. The spark plug according to claim 1, wherein an amount of content of Ir on the cross-section of the tip is not greater than 4 mass %.

3. The spark plug according to claim 1, wherein, when a Vickers hardness on the cross-section of the tip after heat treatment on the tip in an Ar atmosphere at 1300° C. for 10 hours is denoted by Ha, and a Vickers hardness on the cross-section of the tip before the treatment is denoted by Hb, the tip satisfies Hb≥220 HV and Hb/Ha≤1.3.

4. The spark plug according to claim 2, wherein, when a Vickers hardness on the cross-section of the tip after heat treatment on the tip in an Ar atmosphere at 1300° C. for 10 hours is denoted by Ha, and a Vickers hardness on the cross-section of the tip before the treatment is denoted by Hb, the tip satisfies Hb≥220 HV and Hb/Ha≤1.3.

5. The spark plug according to claim 1, wherein the tip further contains not less than 0.5 mass % of Rh.

6. The spark plug according to claim 2, wherein the tip further contains not less than 0.5 mass % of Rh.

7. The spark plug according to claim 3, wherein the tip further contains not less than 0.5 mass % of Rh.

8. A manufacturing method for the spark plug according to claim 1, the manufacturing method comprising:

a preparation step of preparing a wire composed of a plurality of crystal grains and having a diameter corresponding to a diameter of the tip; and a heating step of heating a part in a longitudinal direction of the wire, thereby forming a temperature gradient in the wire and causing the crystal grains to grow in the longitudinal direction.

9. The manufacturing method for the spark plug according to claim 8, further comprising a cooling step of cooling a part in the longitudinal direction of the wire.

10. A manufacturing method for the spark plug according to claim 2, the manufacturing method comprising:

a preparation step of preparing a wire composed of a plurality of crystal grains and having a diameter corresponding to a diameter of the tip; and a heating step of heating a part in a longitudinal direction of the wire, thereby forming a temperature gradient in the wire and causing the crystal grains to grow in the longitudinal direction.

11. The manufacturing method for the spark plug according to claim 10, further comprising a cooling step of cooling a part in the longitudinal direction of the wire.

12. A manufacturing method for the spark plug according to claim 3, the manufacturing method comprising:

a preparation step of preparing a wire composed of a plurality of crystal grains and having a diameter corresponding to a diameter of the tip; and a heating step of heating a part in a longitudinal direction of the wire, thereby forming a temperature gradient in the wire and causing the crystal grains to grow in the longitudinal direction.

13. The manufacturing method for the spark plug according to claim 12, further comprising a cooling step of cooling a part in the longitudinal direction of the wire.

* * * * *